United States Patent [19]

Emrich

[11] Patent Number: 4,647,033

[45] Date of Patent: Mar. 3, 1987

[54] ARRANGEMENT FOR CONVEYANCE OF STREAM-FED SHEETS

[75] Inventor: Helmut Emrich, Offenbach am Main, Fed. Rep. of Germany

[73] Assignee: M.A.N.-Roland Druckmaschinen Aktiengesellschaft, Fed. Rep. of Germany

[21] Appl. No.: 768,934

[22] Filed: Aug. 26, 1985

Related U.S. Application Data

[63] Continuation of Ser. No. 455,995, Jan. 6, 1983, abandoned, which is a continuation-in-part of Ser. No. 423,167, Sep. 24, 1982, abandoned.

[30] Foreign Application Priority Data

Sep. 28, 1981 [DE] Fed. Rep. of Germany ..... 3138481

[51] Int. Cl.[4] ..... B65H 29/32

[52] U.S. Cl. ..... 271/276; 271/197

[58] Field of Search ..... 271/197, 276, 94, 99, 271/112; 198/689

[56] References Cited

U.S. PATENT DOCUMENTS 3,171,647 3/1965 Bishop ..... 271/94

3,904,188 9/1975 Fairbanks et al. ..... 271/197

4,157,177 6/1979 Strecker ..... 271/179

4,295,737 10/1981 Silverberg ..... 198/689

4,363,478 12/1982 Tsukasaki ..... 271/276

*Primary Examiner*—Duane A. Reger

*Attorney, Agent, or Firm*—Leydig, Voit & Mayer

[57] ABSTRACT

A conveyor for sheets fed to or from a printing press in an overlapped stream, the table having longitudinal slots formed therein laterally spaced from one another. A perforated endless conveyor belt is trained over the table. An enclosed chamber extending substantially the length of the table communicates directly with the slots, the chamber being convergently shaped terminating at its lower end in a throat. An axial flow fan in the throat draws air through the perforations so that a stream of overlapped sheets on the belt will be held in contact therewith for transport from one end of the table to the other. The fan is chosen to have a flow characteristic such as to maintain the pressure differential across the fan approximately constant notwithstanding variations in the rate of air flow resulting from gaps in the stream. The belt is in two narrow, laterally spaced sections dimensioned to fit into the slots.

1 Claim, 4 Drawing Figures

ARRANGEMENT FOR CONVEYANCE OF STREAM-FED SHEETS

This application is a continuation of application Ser. No. 455,995, filed Jan. 6, 1983, now abandoned, which is a continuation-in-part of application Ser. No. 423,167, filed Sept. 24, 1982 and now abandoned.

In the conveyance of sheets or signatures into or out of a printing press it is known to use a flat endless perforated belt with either vacuum duct work or an evacuated plenum under the belt for causing the sheets or signatures to adhere. In German Pat. DE-PS No. 723575, for example, there is shown a perforated belt to which a vacuum is applied under the perforations by means of a reciprocating piston-type pump. German document D-AS No. 1033225 discloses a conveyor having an endless wear resistant steel belt incorporating holes through which the vacuum is applied. In German document DE-PS No. 1123679 transport belts are arranged in pairs straddling a set of longitudinally spaced openings communicating with a series of vacuum ducts. German document DE-AS No. 1181240 describes a feeder board of the evacuated type using specially constructed conveyor belts having longitudinal ribs on their underside for confinement of the airstream.

It will be apparent upon inspection that all of these arrangements are relatively complicated and expensive. For the most part they employ ducts of narrow cross section having high fluid friction and limited air flow capacity, with the result that the degree of suction is subject to wide swings, particularly where there are sudden changes in the rate of air flow resulting from gaps in the stream of conveyed sheets. Briefly stated, systems of the conventional type, of which the above publications are representative, may be engineered to exert the optimum degree of vacuum when the sheets are in a constant overlapped stream covering all of the active perforations, but where the stream is incomplete and irregularly interrupted, air is bypassed around the active perforations resulting in wide variations in holding force. In most prior systems which employ a vacuum plenum, interruptions in the stream are particularly troublesome because of the resultant "dumping" of vacuum resulting in a time delay for pumping down the plenum when the continuity of the stream is reestablished. The peak suction forces reached in conventional systems, and the resultant peaks of frictional loading, require conventional systems to be heavily designed and highly powered.

It is, accordingly, an object of the present invention to provide a vacuum type conveyor for sheets or signatures which is highly reliable and which exerts a substantially constant degree of suction in spite of gaps in the stream. Indeed, it is an object to provide a vacuum type conveyor in which the holding force on each sheet is approximately constant regardless of whether the sheet is a part of a tightly and uniformly overlapped stream or whether the sheet passes along the conveyor singly, surrounded on both ends by perforations through which air is being idly drawn and which would, in normal constructions, act to defeat the vacuum.

It is another object to provide a vacuum type conveyor which is of simple and highly economical construction utilizing a table having a pair of longitudinal slots communicating with an axial flow fan having a large inlet opening, a belt being provided in narrow laterally-spaced sections registering with the slots. Thus it is an object of the invention to provide a conveyor employing a perforated belt to which suction is applied directly by a fan of the axial flow type without any interposed duct work and without requiring any plenum which must be pumped down to a working level. More specifically it is an object to provide a vacuum type conveyor employing a perforated conveyor belt in which there is a minimum of fluid friction in the system between the belt and the evacuating fan resulting in sustained vacuum at the perforations regardless of the rate of air flow.

It is still another object of the present invention to provide a vacuum type conveyor capable of exerting a constant light suction force against the sheet regardless of whether the sheet is fed singly or is part of a tightly continuous stream to avoid peak levels of frictional drag and making it possible to use a belt and belt supports which are lightly constructed and capable of being driven by light driving forces using a driving motor of only limited power.

It is, finally, an object of the invention to provide a vacuum type conveyor which is highly compact, which is easily installed, which is capable of integration into existing types of conveyor assemblies and which utilizes an axial flow type of fan and inlet bell which may be ordered as a competitively priced catalogue item.

Other objects and advantages of the invention will become apparent upon reading the attached detailed description and upon reference to the drawing in which.

Figures 1, 2, 2A, 3:
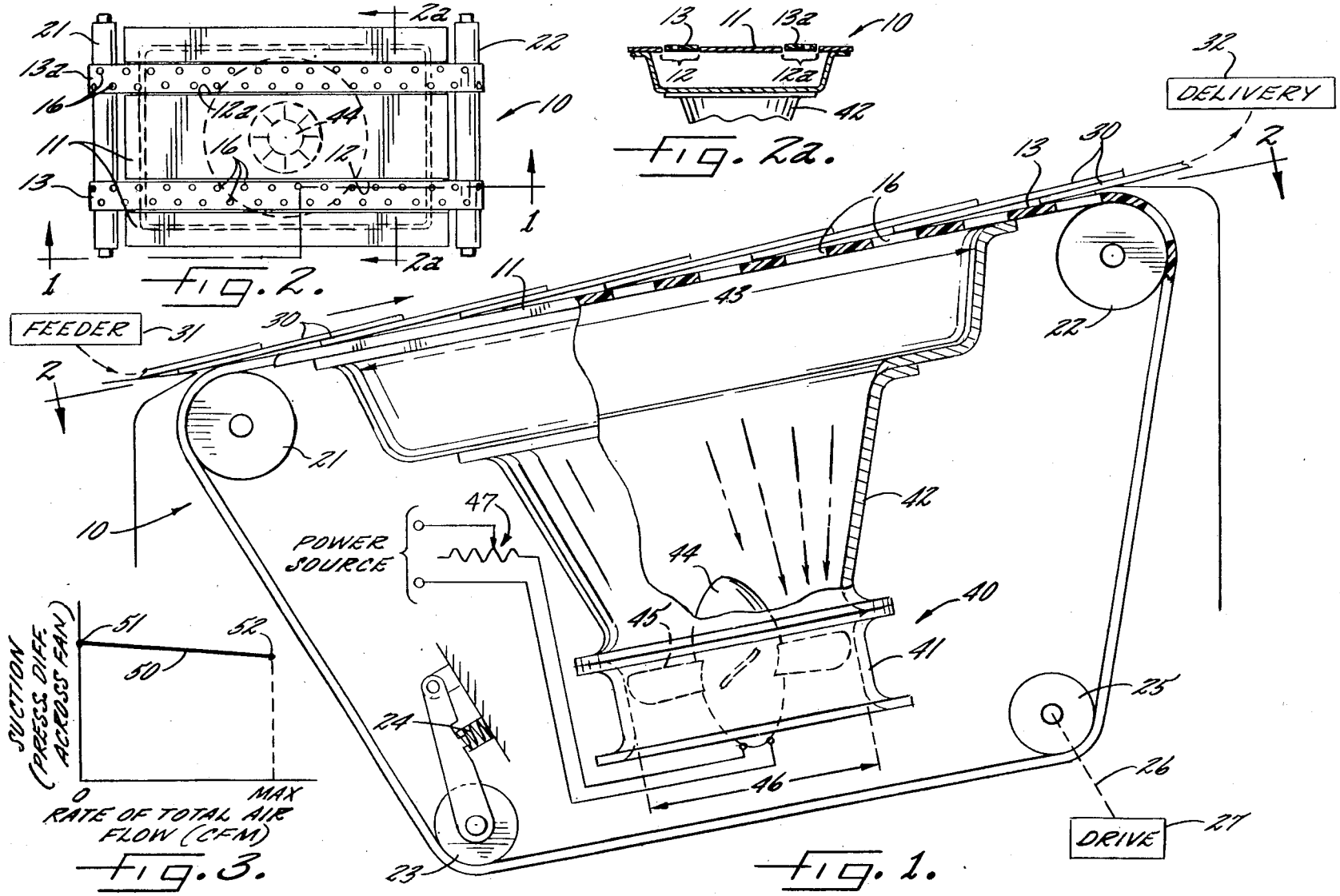
FIG. 1 is an elevational view of a vacuum type sheet conveyor constructed in accordance with the present invention as viewed along line 1—1 in FIG. 2.
FIG. 2 is a top view of the device shown in FIG. 1 looking along line 2—2 in the latter figure.

FIG. 2*a* is a fragmentary section taken along line 2*a*—2*a* in FIG. 2.

FIG. 3 is a characteristic curve showing the approximate degree of suction at the perforations as a function of the rate of total air flow.

While the invention has been described in connection with a preferred embodiment, it will be understood that I do not intend to be limited to the embodiment shown, but intend, on the contrary, to cover the alternative and equivalent constructions included within the spirit and scope of the appended claims.

Turning now to the drawing, there is shown a vacuum type conveyor 10 having a support or table 11 with a pair of longitudinal slots 12 and 12*a* (FIG. 2*a*) formed therein. Trained over the table is a perforated conveyor belt consisting of two sections 13, 13*a* having a delivery run which extends flatly over the table and a return run spaced under the table. The belt has an all-over pattern of perforations 16.

For the purpose of supporting and driving the belt, it is trained over idler rollers 21, 22 which are arranged substantially tangent to the plane of the table, about a take-up roller 23, swingably mounted and biased by a take-up spring 24, and a drive roller 25 having a connection 26 to a driving source 27. The belt as a result is driven at a desired speed along the table in the direction of the arrow.

Arranged on the belt and passing in the direction of the arrow are a stream of sheets 30 which are deposited thereon by a feeder 31 for conveyance to a delivery 32. As illustrated, the sheets are in a state of constant overlap. However, the invention is not limited to conveyance of a stream which is overlapped and the sheets may be conveyed, for certain applications, seriatim, either end to end or spaced on the belt regularly or irregularly. The term "sheet" as used herein will be understood to include a signature made up of a single sheet or a number of sheets having a common central fold.

In accordance with one of the features of the present invention, an axial flow fan is arranged on the underside of the table with its axis substantially perpendicular thereto, the fan having a narrow throat and a superimposed convergent bell close coupled to the throat, the bell defining a large inlet opening substantially larger than the throat and dimensioned to extend laterally beyond the slots in the table for drawing air through the perforations in the belt. The flow characteristic of the axial flow fan is such as to maintain the suction at the inlet opening of the fan and, consequently, the suction at the perforations in the belt, approximately constant, notwithstanding variations in the rate of air flow resulting from gaps in the stream.

Thus I provide an axial fan assembly 40 which includes an axial flow fan 41 and a superimposed, convergent bell 42, the bell having wide inlet opening 43. The fan has a motor 44 driving a set of radial blades 45. The inlet opening 43 of the bell is substantially larger than the throat 46 of the fan and dimensioned to accommodate the slots 12, 12*a* in the table so that air tends to be drawn through the belt perforations in the axial direction of the fan. The air passing through the perforations either as a result of the porousity of the sheets or by reason of uncovering of any of the perforations flows in a generally axial direction from entry to discharge without any abrupt change in direction, and without substantial friction or wire-drawing, contributing to the efficiency of the device.

The axial flow fan 40 which is utilized in the present invention may be secured as a catalogue item having the suction vs. flow characteristic which is illustrated at 50 in FIG. 3. In this figure it will be noted that the characteristic is reasonably flat. Thus when the stream of sheets is continuous and all of the active perforations, that is perforations subject to vacuum, are covered, there will be a certain pressure differential across the fan indicated at 51 and which is simply referred to as the "suction". When the stream is totally interrupted so that all of perforations are uncovered and subject to the flow of idle air, the rate of air flow through the fan is a maximum and corresponds to a suction level, at the perforations, as idicated at 52. Desirably, suction at the perforations is sustained regardless of whether the perforations are covered or uncovered. In short each sheet is treated the same regardless of whether it is part of a continuous stream or is transported individually on the conveyor surrounded, at each end, by perforations which idly bypass the air. An example of an axial flow fan, including a convergent bell, or mounting ring, which may be used and which is available as a catalogue item is that designated as Type AE200-2W produced by Electrobau Mulfingen GMBH, Postfach 7, D 7119 Mulfingen/-Wuertt, West Germany.

It will be apparent upon understanding the significance of FIG. 3 that the suction applied to the sheet is maintained at or near the optimum level. The optimum level may be adjusted by any simple means for controlling the fan speed as for example a variable series resistor 47. The control 47 may be adjusted to produce a slower fan speed for thin sheets of single ply and a relatively faster speed for thicker sheets or where the sheets are in the form of multi-page "signatures". Regardless of the running level of suction which is selected, there is a complete absence of peaks in the characteristic curve and thus the belt and its supports need not be designed to accommodate peak forces which produce high levels of friction and which thus require high peak levels of driving power. On the contrary the belt and its supporting and driving elements may be lightly constructed using a drive having only limited torque contributing substantially to the economy of construction and operation.

Utmost economy is also brought about by the fact that the fan and its bell are handled and installed as a unit without any necessity for the running of ducts and without necessity for a plenum. Indeed, the bell itself provides all the chamber that is necessary, the fan, in effect, being mounted in one wall thereof. Unlike conventional ductwork which is slow to respond and which requires "pumping down" over a period of time to recover from a gap in the stream, the present axial flow fan arrangement has substantial zero recovery time, due to the direct axial flow of air and the exceedingly small amount of transport friction, substantially all of the friction being that due to the belt perforations.

The table may be surfaced, if desired, with a layer of Teflon or similar material to provide self lubrication. The belt itself may be formed of a highly flexible dimensionally stable plastic or rubber tensioned sufficiently to avoid any substantial "concaving" below the level of the table. While use of two belt suctions is preferred, it will be apparent that three sections, for example, may be used without departing from the invention.

I claim as my invention:

1. A sheet transfer apparatus in a printing press for conveying a continuous flow of flexible paper sheets at press speed, the combination comprising a table disposed in the flow path of the sheets, means for feeding a stream of overlapped, flexible paper sheets onto one side of the table, the table having at least two laterally spaced slots formed therein extending the length of the table, a plurality of narrow endless conveyor belts each having a delivery run trained over the table for supporting a continuous stream of the sheets and transferring the sheets in partially overlapping relation in a substantially continuous flow completely across said table to a delivery station beyond a side of said table opposite said feeding means with only the underside of a portion of each successive sheet being in direct contact with the belts, said belts each having a return run spaced under the table, means for driving the conveyor belts, said belts being formed with a continuous array of perforations along the length thereof, means for defining an enclosed chamber located immediately below the table having direct communication with the slots, means including a fan in the wall of the chamber for creating a vacuum in the chamber for drawing air through the perforations and so that a stream of overlapped sheets on the belts will be held in contact therewith for transport completely across the table with the overlapping relation of the sheets being undisturbed and with the sheets remaining in a substantially square relation to the line of travel all without auxiliary means for guiding movement of the sheets, said fan being of the axial flow type spaced below the table and with its axis substantially perpendicular thereto, said enclosed chamber extending substantially the length of the table and being convergently shaped with an inlet throat at its lower end within which said axial flow fan is located, and said fan having a flow characteristic and being operable so as to maintain a pressure differential across the fan and a suction pressure across said belts that are approximately constant notwithstanding variations in the rate of air flow resulting from gaps that might occur in the stream of sheets being fed on said belt.

* * * * *